US005282687A

United States Patent [19]

Yee

[11] Patent Number: 5,282,687

[45] Date of Patent: Feb. 1, 1994

[54] FLEXIBLE PACKAGING WITH COMPRESSION RELEASE, TOP OPENING FEATURE

[75] Inventor: Paul Y. Yee, Neenah, Wis.

[73] Assignee: Kimberly-Clark Corporation, Neenah, Wis.

[21] Appl. No.: 843,698

[22] Filed: Feb. 28, 1992

[51] Int. Cl.[5] ..... B65D 33/06

[52] U.S. Cl. ..... 383/25; 383/207

[58] Field of Search ..... 383/25, 207

[56] References Cited

U.S. PATENT DOCUMENTS

| | | | |
|---|---|---|---|
| 2,448,819 | 9/1948 | Mitchell | 206/57 |
| 2,478,412 | 8/1949 | McMahan | 206/47 |
| 2,651,409 | 9/1953 | Fay | 206/57 |
| 2,998,911 | 9/1961 | Hahn et al. | 229/66 |
| 3,012,692 | 12/1961 | Petersen | 221/63 |
| 3,124,298 | 3/1964 | Repko | 229/66 |
| 3,161,336 | 12/1964 | Loescher | 225/106 |
| 3,162,353 | 12/1964 | Sylvester et al. | 229/53 |
| 3,174,644 | 3/1965 | Kaltman et al. | 221/63 |
| 3,227,359 | 1/1966 | Hanlon | 229/66 |
| 3,826,361 | 7/1974 | Heckrodt | 206/409 |
| 4,062,486 | 12/1977 | Goodrich | 206/626 |
| 4,175,673 | 11/1979 | McDonald et al. | 221/63 |
| 4,252,269 | 2/1981 | Peppiatt | 229/54 R |
| 4,328,655 | 5/1982 | Spencer et al. | 53/439 |
| 4,460,088 | 7/1984 | Rugenstein et al. | 206/494 |
| 4,487,318 | 12/1984 | Roen | 206/554 |
| 4,539,705 | 9/1985 | Baines | 383/8 |
| 4,540,091 | 9/1985 | Habock | 206/494 |
| 4,550,439 | 10/1985 | Peppiatt et al. | 383/8 |
| 4,557,385 | 12/1985 | Robinson | 206/620 |
| 4,573,203 | 4/1989 | Peppiatt | 383/29 |
| 4,633,649 | 1/1987 | Gautier et al. | 53/413 |
| 4,685,276 | 8/1987 | Kiel | 53/459 |
| 4,691,368 | 9/1987 | Roessiger | 383/10 |
| 4,713,839 | 12/1987 | Peppiatt | 383/29 |
| 4,715,635 | 12/1987 | Koskinen | 294/68.1 |
| 4,717,262 | 1/1988 | Roen et al. | 383/120 |
| 4,721,396 | 1/1988 | Sengewald | 383/8 |
| 4,730,942 | 3/1988 | Fulcher | 383/7 |
| 4,730,943 | 3/1988 | Johnson | 383/8 |
| 4,738,546 | 4/1988 | Sengewald | 383/7 |
| 4,838,429 | 6/1989 | Fabisiewicz et al. | 206/605 |
| 4,854,733 | 8/1989 | Schwinn | 383/25 |
| 4,867,575 | 9/1989 | Wood | 383/17 |
| 4,874,255 | 10/1989 | Ball et al. | 383/8 |
| 4,874,256 | 10/1989 | Baines | 383/21 |
| 4,877,335 | 10/1989 | Bernard | 383/6 |
| 4,877,336 | 10/1989 | Peppiatt | 383/8 |
| 4,934,535 | 6/1990 | Muckenfuhs et al. | 206/610 |
| 4,966,286 | 10/1990 | Muckenfuhs | 206/610 |
| 5,036,978 | 8/1991 | Frank et al. | 206/494 |
| 5,050,742 | 9/1991 | Muckenfuhs | 206/610 |
| 5,054,619 | 10/1991 | Muckenfuhs | 206/610 |
| 5,059,034 | 10/1991 | Schulz et al. | 383/25 |
| 5,112,138 | 5/1992 | Peppiatt | 383/29 |
| 5,121,995 | 6/1992 | Newman et al. | 383/207 |

FOREIGN PATENT DOCUMENTS

| | | |
|---|---|---|
| 0425008A1 | 10/1990 | European Pat. Off. . |
| 3629563 | 8/1986 | Fed. Rep. of Germany . |
| 3642327 | 12/1986 | Fed. Rep. of Germany . |
| 9109154.3 | 7/1991 | Fed. Rep. of Germany . |
| 2035258A | 6/1980 | United Kingdom . |
| 92/18396 | 10/1992 | World Int. Prop. O. . |

OTHER PUBLICATIONS

Kimberly-Clark Corp. Purchase Order No. 03644143KW Jan. 9, 1990—Paramount Packaging Corp. (3 pages).

*Primary Examiner*—Stephen P. Garbe

*Attorney, Agent, or Firm*—Paul Yee

[57] ABSTRACT

A bag for receiving and containing a substantially stacked array of selected articles includes a flexible front panel which has two opposed side edge regions, a top edge region, and an appointed lengthwise stack direction. A flexible back panel has two opposed side edge regions and a top edge region, and is connected in facing relation to the front panel along the side edge regions thereof. A flexible top gusset connects to the top edge regions of the front and back panels. The top gusset and one or more of the front and back panels have an appointed line of frangibility extending at least partially there across along a direction which is transverse to the stack direction. The line of frangibility is entirely spaced from each of the panel side edge regions by a distance which is not less than ½ a width dimension of the stacked array of articles.

21 Claims, 5 Drawing Sheets

FLEXIBLE PACKAGING WITH COMPRESSION RELEASE, TOP OPENING FEATURE

FIELD OF THE INVENTION

The present invention relates to flexible plastic bags for receiving and containing packaged articles. More particularly, the present invention relates to a flexible bag having an improved compression release, top opening feature.

BACKGROUND OF THE INVENTION

Bag packages composed of flexible polymer materials have been used for packaging various types of products, such as infant diapers, feminine care products and adult incontinence garments. The bags allow a packaging of the articles to create a carton-like look and configuration which facilitates transportation and display on retail shelves. The bags typically include handles to facilitate the carrying of individual packages from the retail shelves, and can include mechanisms for providing an access opening through the top and end panels of the package.

For example, U.S. Pat. No. 4,252,269 issued Feb. 24, 1981, to H. Peppiatt describes a bag of polymeric plastic material which has an opening at one end and a gusset at the opposite end. Within the gusset there is disposed a handle welded to front and rear panels of the bag along a fold line. The handle is shorter than the length of the gusset.

U.S. Pat. No. BI 4,573,203 (Reexamination Certificate) issued Apr. 18, 1989 (patent issued Feb. 25, 1986) describes a reusable plastic bag with a loop handle. The bag is for packaging goods in a sealed manner with perforations being provided to facilitate access to the goods without interfering with the reusability of the bag. A number of flexible bag designs have incorporated a mechanism which opens a predetermined portion of a tensioned side panel of the bag, without releasing the tension in the remainder of the side panel. For example, see U.S. Pat. No. 5,036,978 issued Aug. 6, 1991, to M. Frank et al.; U.S. Pat. No. 4,934,535 issued June 1990 to Muckenfuhs et al.; U.S. Pat. No. 4,966,286 issued October 1990 to Muckenfuhs; U.S. Pat. No. 5,050,742 issued Sep. 24, 1991, to D. Muckenfuhs; and U.S. Pat. No. 5,054,619 issued Oct. 8, 1991, to D. Muckenfuhs.

Conventional plastic bags, such as those described above, however, have not provided the desired combination of convenient portability and a substantially interference-free access to the packaged articles through the top of the bag. The relatively large openings in the end panels of the package can too easily allow articles to fall out of the partially emptied package. In addition, the opening at the end panel can make it more difficult to use the partially filled package as a temporary carrier for accessory, personal care articles.

BRIEF DISCLOSURE OF THE INVENTION

The present invention provides a distinctive bag for receiving and containing a substantially stacked array of selected articles. The bag includes a flexible front panel which has two opposed side edge regions and a top edge region, and which has an appointed lengthwise stack direction. A flexible back panel has two opposed side edge regions and a top edge region, and is connected in facing relation to the front panel along the side edge regions thereof. A flexible top gusset connects to the top edge regions of the front and back panels. The top gusset and one or more of the front and back panels has an appointed line of frangibility extending at least partially there across along a direction which is transverse to the stack direction. The line of frangibility is entirely spaced from each of the panel side edge regions by a distance which is not less than ½ a width dimension of the stacked array of articles.

Another aspect of the invention provides a bag composed of flexible material and containing a substantially stacked array of compressed articles. The bag includes a front face panel which has a top edge region and has an appointed lengthwise stack direction. The stacked array extends substantially along the stack direction and the articles are compressed along the stack direction when contained within the bag. A back face panel has a top edge region and is arranged in facing relation with the front face panel. A flexible top panel connects to the top edge regions of the front face panel and back face panel. A pair of spaced apart, opposed end panels connect to the top panel and interconnect between the front and back face panels. A bottom panel connects to the end panels and the front and back face panels. The top panel and one or more of the front and back face panels has an appointed line of frangibility extending at least partially there across along a direction which is transverse to the stack direction. The line of frangibility is entirely spaced from each of the end panels.

The present invention can advantageously provide a bag which provides improved access to a stacked array of compressed articles contained therein. In particular, the opening feature of the bag can partially release the compressive forces within the packaged articles to facilitate the removal of the first articles from the package. The relatively restricted opening can better retain the articles within the package even when the package is only partially filled. The bag can also provide a convenient access through the top of the bag and can preserve the utility of the bag for carrying accessory articles such as containers of lotions, powders, or cleansing wipes.

BRIEF DESCRIPTION OF THE DRAWINGS

The present invention will be more fully understood and further advantages will become apparent when reference is made to the following detailed description of the invention and the accompanying drawings in which.

DETAILED DESCRIPTION OF THE INVENTION

The present invention provides a distinctive bag for receiving and containing selected articles. The bag is particularly useful for packaging disposable absorbent garments, such as disposable diapers, feminine care products, incontinence garments and the like. It is readily apparent, however, that the bag could be suitable for packaging other articles which can be stacked or otherwise arranged into a carton-like configuration for packaging.

Figure 1:
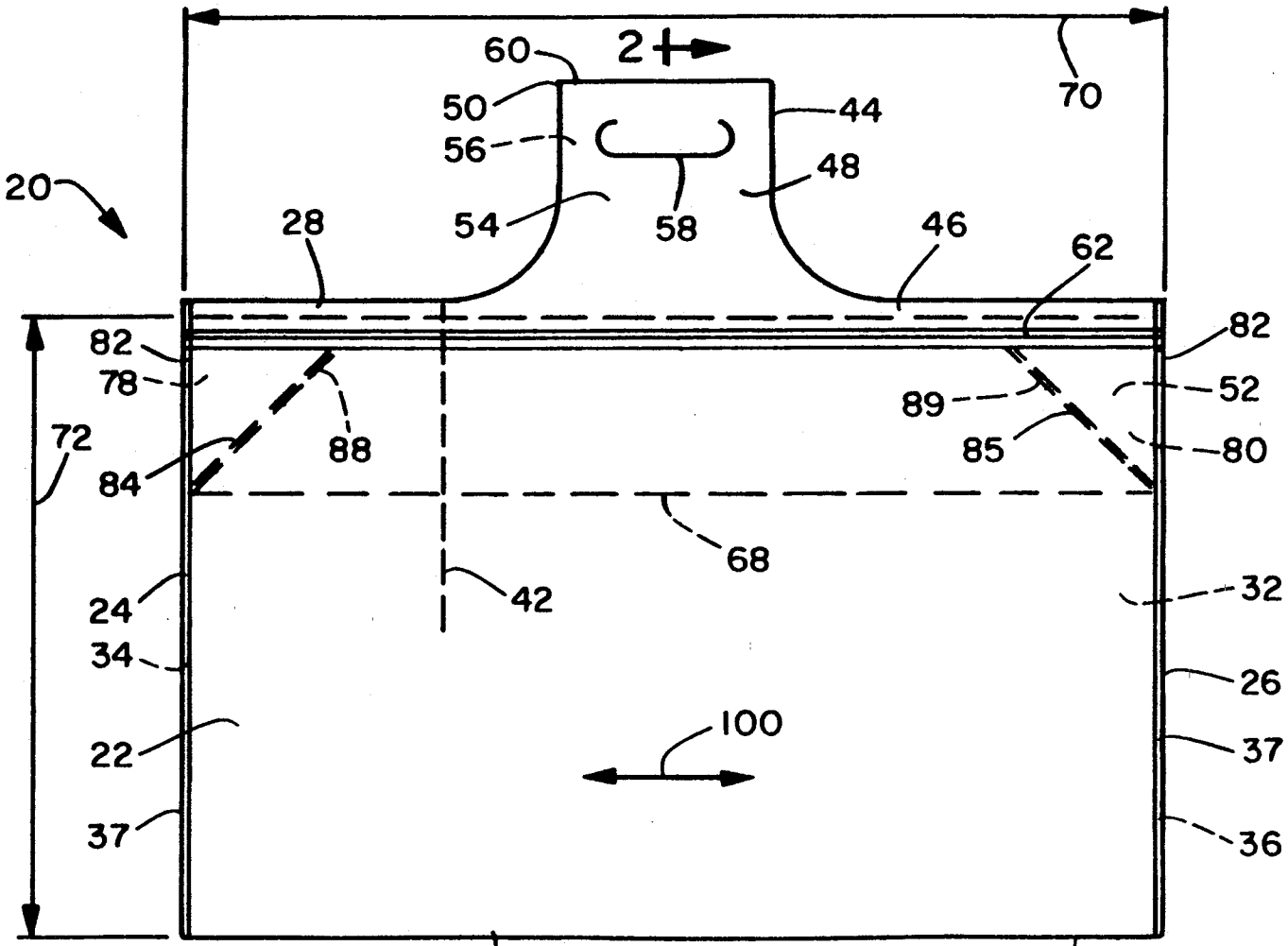
FIG. 1 representatively shows a side view of an unfilled bag.
Figure 3:
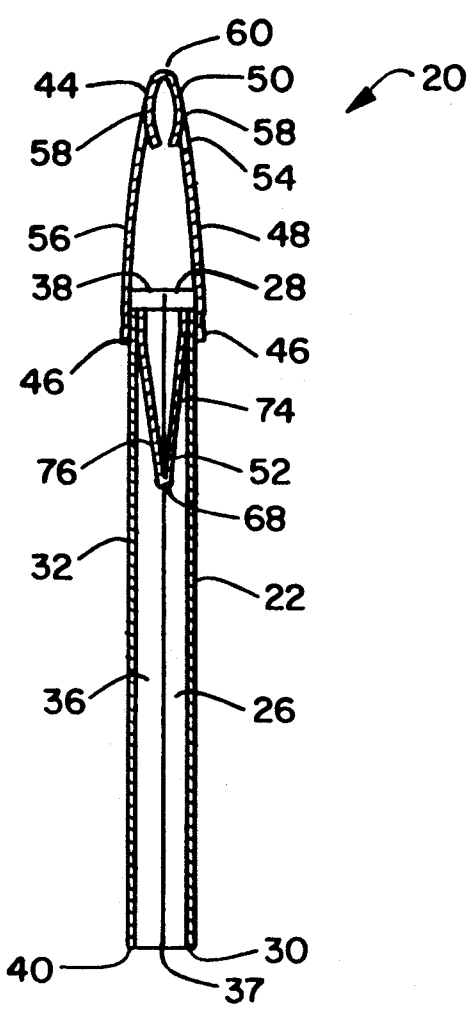
FIG. 3 representatively shows a cross-sectional, end view of another embodiment of the invention having a separate, false gusset.
Figure 2:
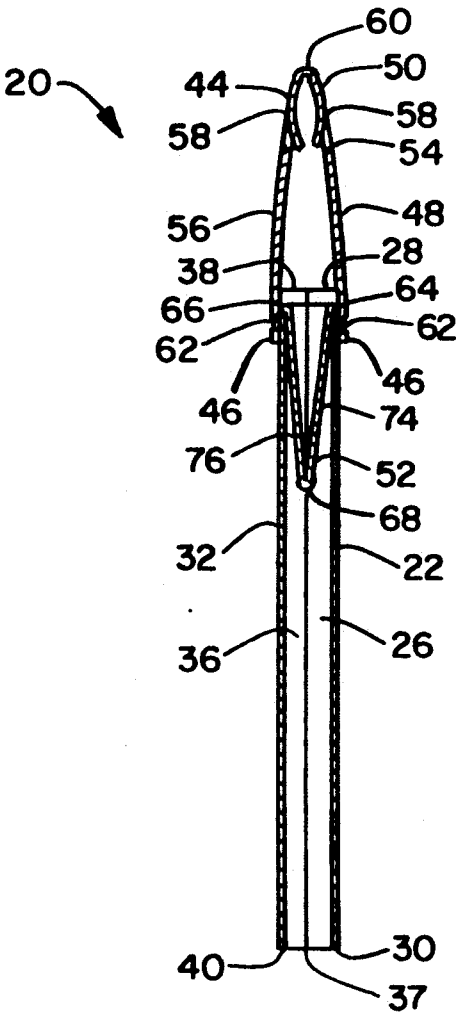
FIG. 2 representatively shows a cross-sectional, end view of the bag taken along line 2—2 of FIG. 1.
Figure 9:
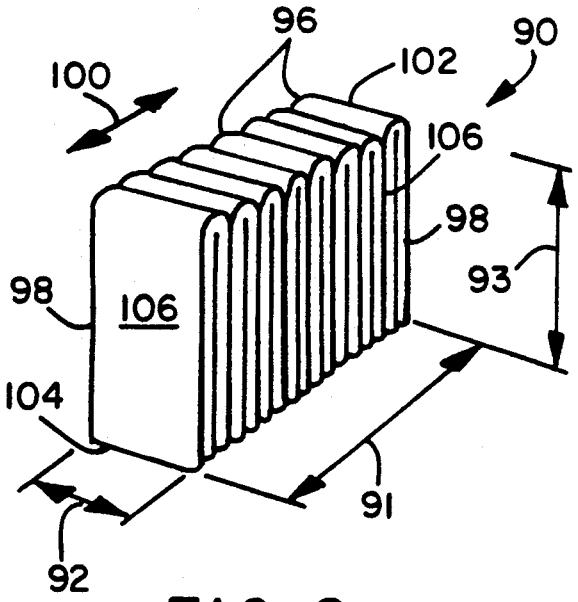
FIG. 9 shows a representative stack array of articles.
Figure 10:
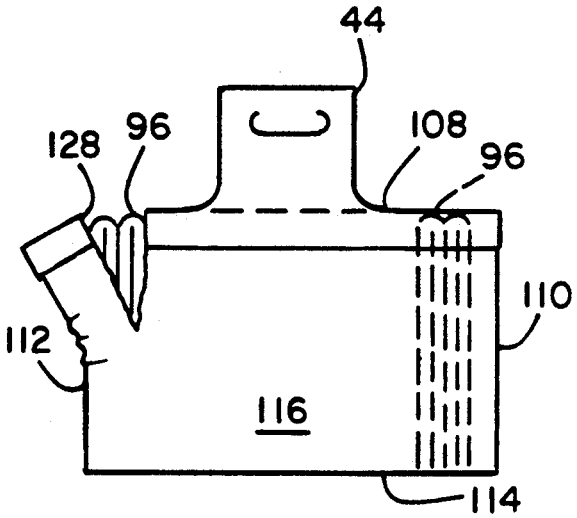
FIG. 10 representatively shows a side view of a filled bag in which the opening mechanism of the invention has been activated.

With reference to FIGS. 1 and 2, bag 20 includes a front panel 22, which has two opposed side edge regions 24 and 26, a top edge region 28 and a bottom edge region 30. A back panel 32 has two opposed side edge regions 34 and 36, a top edge region 38 and a bottom edge region 40. The back panel is connected in a generally adjacent, facing relation to front panel 22 along the corresponding adjacent side edge regions thereof. As a result, the two sets of connected side edges (24, 34 and 26, 36) form a pair of connected end regions. In addition, the front and back panels have an appointed lengthwise stack direction 100. A top gusset member 52 is connected to the top edge regions 28 and 38 of front panel 22 and back panel 32. The top gusset and one or more of the front and back panels have an appointed line of frangibility 42 extending at least partially there across along a direction which is transverse to stack direction 100. The line of frangibility is entirely spaced from each of the front and back panel side edge regions by a distance which is not less than ½ an appointed width dimension 92 of the stacked array of articles 90 (FIG. 9). The width dimension of the stacked array substantially corresponds to the width dimension of top gusset 52 when the top gusset is spread out in its unfolded, extended-flat condition. Accordingly, the entirety of the line of frangibility 42 is spaced from each of the front and back panel side edge regions by a distance which is not less than ½ an effective width dimension of top gusset 52.

Figure 11:
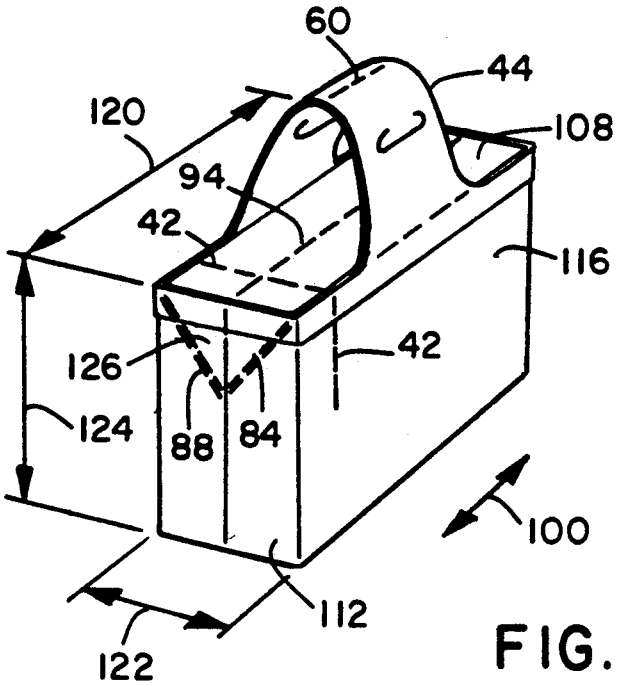
FIG. 11 representatively shows a perspective view of an embodiment of a filled bag of the invention in which the handle web traverses across the package top wall along the width dimension of the bag.

Bag 20 may additionally include a handle web member which connects to the top edge regions 28 and 38 of the front and back panels 22 and 32 (e.g. FIG. 11). Handle web 44 has a mounting portion 46 for connecting to the front and back panels, and a strap portion 48 for providing a carrying loop 50. The carrying loop is constructed to bridge transversely over top gusset 52 and to extend between front panel 22 and back panel 32. The carrying loop can be constructed and arranged to provide for an arm suspension of bag 20 through use of the carrying loop.

Figure 12:
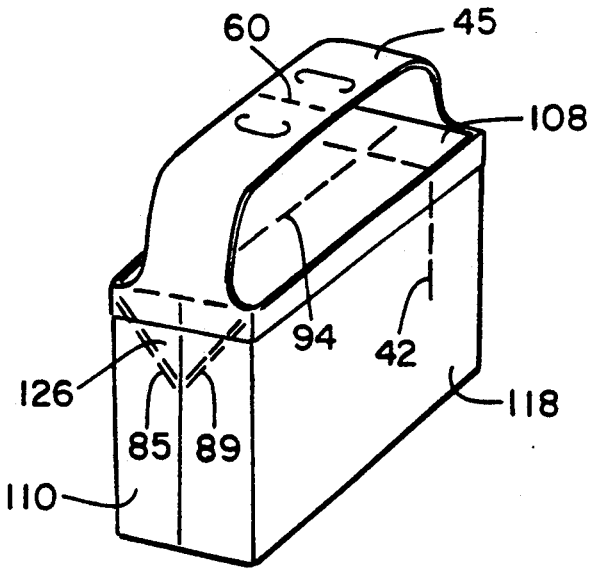
FIG. 12 representatively shows a perspective view of another embodiment of a filled bag of the invention in which the handle web traverses across the package top wall along the length dimension of the bag.
Figure 13:
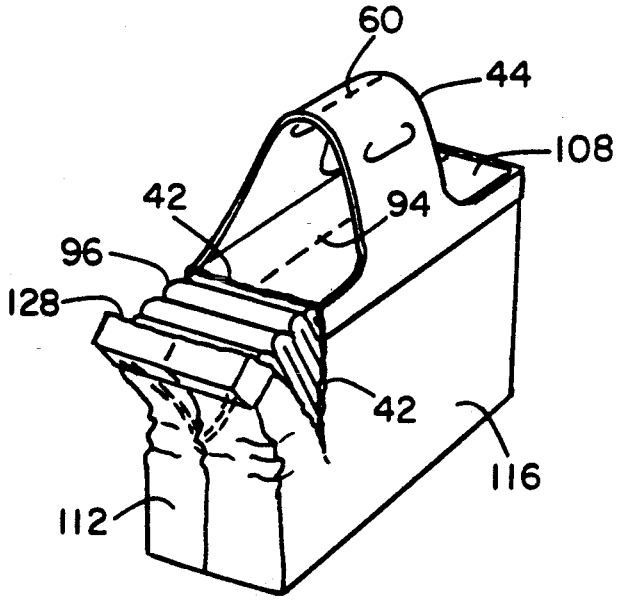
FIG. 13 representatively shows a perspective view of a filled bag of the invention in which the top opening mechanism ha& been activated.

In another aspect of the invention, a handle web member 45 may be constructed to bridge longitudinally over top gusset 52 and arranged to extend generally along stack direction 100, as representatively shown in FIG. 12. A mounting portion of handle web 45 connects to longitudinally spaced apart, top edge regions 28 and 38 of the front and back panels 22 and 32, and a strap portion of handle web 45 provides a suitable carrying loop. The carrying loop is constructed to bridge longitudinally over top gusset 52 and to extend between the opposed end walls 110 of a filled package. The carrying loop can be constructed and arranged to provide for an arm suspension of bag 20.

In the various embodiments of the invention, carrying loop 50 may further provide two generally opposed loop faces 54 and 56. Each of the loop faces can have at least one hand-grip opening 58 formed therein with the hand-grip openings configured to provide for a hand-suspension of bag 20. Carrying loop 44 may optionally include an appointed separation section, such as frangible section 60, located at a selected, intermediate position between hand-grip openings 58.

The separation section is constructed and arranged to provide for a reconfiguration of the carrying loop into separate, independently movable strap portions. In the illustrated embodiment, frangible section 54 of carrying loop 44 extends generally aligned with top edge region 28 of front panel 22, and is constructed with sufficient tensile load capacity to permit the arm-suspension of bag 20 while the bag is substantially filled with the selected articles.

Front panel 22 and back panel 32 may be composed of different materials, or may be composed of substantially the same type of material. Typically, the material is a polymer film which is sufficiently flexible to assume a desired, generally hexahedral shape when the bag is substantially filled with articles. In addition, the material should have sufficient strength to hold and contain the articles without breaking and without excessive bulging or stretching of the film material. In the illustrated embodiment, for example, the film material may be composed of a polyethylene film or film laminate having a thickness of about 2.5 mils (about 0.0635 millimeters). For example, the film material may comprise a LDPE (low density polyethylene) film, a LDPE/LLDPE (linear low density polyethylene) film laminate, a LDPE/MDPE (medium density polyethylene) film laminate, a LDPE/HDPE (high density polyethylene) film laminate or the like.

With reference again to FIGS. 1 and 2, the shown embodiment of front panel 22 includes two opposed, generally parallel side edge regions 24 and 26. The front panel further includes a top edge region 28 which generally interconnects and runs substantially perpendicular to the side edge regions. The front panel has a length dimension 70 and a depth dimension 72. It is readily apparent that the panel length and depth dimensions will vary depending upon the size and the desired configuration of the packaged articles.

The shown embodiment of back panel 32 includes two opposed, generally parallel side edge regions 34 and 36. The back panel further includes a top edge region 38 which extends substantially perpendicular to side edge regions 34 and 36, and generally interconnects the side edge regions. In the illustrated embodiment, back panel 32 is generally coextensive with front panel 22 and is positioned in an adjacent, facing relation with the front panel. Thus, a major face surface of the back panel is located generally parallel and side-by-side to a major face surface of the front panel. The two side edge regions 34 and 36 of back panel 32 are suitably interconnected with the correspondingly adjacent side edge regions 24 and 26 of front panel 22. The interconnecting assembly of the front and back panels may be accomplished by various techniques well known in the art, such as adhesive bonding, thermal bonding, ultrasonic bonding, welding, and the like. Alternatively, the interconnection may be accomplished with inter-engaging mechanical fastening systems, such as sewing, stapling, riveting, and the like. Similarly, the other component parts of bag 20 described in the present specification can be attached or otherwise connected together employing the above-described assembly techniques. In the illustrated embodiment, back panel 32 and front panel 22 are secured and fused to each other along their respective side edge regions by thermal bonding lines 62.

Top gusset member 52 is operably connected to the top edge regions 28 and 38 of front panel 22 and back panel 32. Top gusset 52 may be integrally formed with either of front panel 22 or back panel 32, or may be integrally formed with both the front and back panels. Alternatively, top gusset 52 may be a separate web of material which is assembled to top edge 28 of front panel 22 and top edge 38 of back panel 32. The top gusset is typically composed of a flexible polymer film material, such as the material employed to construct front panel 22 or back panel 32. In the illustrated embodiment, for example, top gusset 52 is composed of a LDPE film laminate having a thickness of about 2.5 mils (about 0.0635 millimeters).

With reference to the embodiment representatively shown in FIG. 2, top gusset 52 is integrally formed with both front panel 22 and back panel 32. Accordingly, a unitary web of material is selectively folded to form the top gusset and the front and back panels. The top gusset extends from fold line 64 to fold line 66 and includes a medial fold line 68. Fold line 64 provides a line of demarcation between front panel 22 and top gusset 52. Similarly, fold line 66 provides a line of demarcation between back panel 32 and the top gusset. Medial fold line 68 effectively divides the top gusset into two gusset panel sections 74 and 76. In the illustrated embodiment, fold line 68 extends substantially down the center of top gusset 52, and generally bisects the top gusset to define gusset panel sections 74 and 76, which are substantially equal in size. The top gusset has a gusset length dimension 70, and has an unfolded, extended width which substantially corresponds to the desired package width 122 (FIG. 11).

Top gusset member 52 in its folded condition, operatively delimits two panel sections 74 and 76, with each panel section including its respective portions of gusset end regions 78 and 80. In the construction of the illustrated embodiment, top gusset 52 is positioned in its folded condition, and the gusset end portions of gusset panel section 74 are suitably attached by bonding lines 82 or otherwise connected to the correspondingly adjacent gusset end portions of gusset panel section 76. Additionally, the gusset end portions of gusset panel 74 are connected to side edge regions 24 and 26 of front panel 22, and the gusset end portions of gusset panel section 76 are suitably connected to side edge regions 34 and 36 of back panel 32.

In an alternative embodiment of the invention where top gusset 52 is a separate member assembled to front panel 22 and back panel 32, the top gusset member may be composed of a material which is different than the material comprising the front and back panels. Upon assembly, the longitudinal, lengthwise edge regions of the top gusset member will be connected by suitable fastening mechanisms to the front and back panels along the regions thereof which generally correspond to fold lines 64 and 66.

In the particular embodiment of the invention, the panel sections of top gusset 52 may be joined to front panel 22 and back panel 32 with selected groups of diagonally extending lines of attachment. With reference to FIG. 1, gusset panel section 74 can be attached to front panel 22 with diagonally extending lines of attachment, such as gusset thermal bonds 84 and 85. Similarly, gusset panel section 76 can be attached to back panel 32 with diagonal thermal bonds 88 and 89. The angle and placement of the diagonal bonds are selected and arranged such that the filled package assumes and reliably maintains the desired carton-like appearance. In the representatively shown embodiment, for example, the diagonal bonds have a width of about 0.125 inch (about 0.32 cm), and have a length which is generally aligned at an angle of about 45 degrees downwardly from bond line 62. In the illustrated embodiment, the downward end of the diagonal bond intersects its respective side panel bond 37 at a point located approximately 0.75 inch above gusset fold line 68. The side panel bond has a width of about 0.375 inch (about 0.952 cm).

To facilitate access to the bag contents, top gusset 52 and either or both of front panel 22 and back panel 32 have a substantially continuous, appointed line of frangibility which extends at least partially there across along a direction transverse to stack direction 100. The entirety of the line of frangibility is spaced away from each of the side edge regions of front panel 22 and back panel 32 by a distance which is not less than ½ the width dimension 92 of the stacked array 90 of the articles contained within the bag (FIG. 9). For example, frangible line 42 may be configured to extend partially across top gusset 52 and partially across front panel 22. Alternatively, frangible line 42 may be configured to extend partially across top panel 52 and back panel 32. In the representatively shown embodiment of the invention, frangible line 42 extends completely across top panel 52 and extends at least partially across both of front panel 22 and back panel 32. Where frangible line 42 traverses a section of the mounting portion of handle web 44, the mechanism of frangibility is operably incorporated into the traversed section of the handle web to allow the desired opening of the bag.

Figure 7:
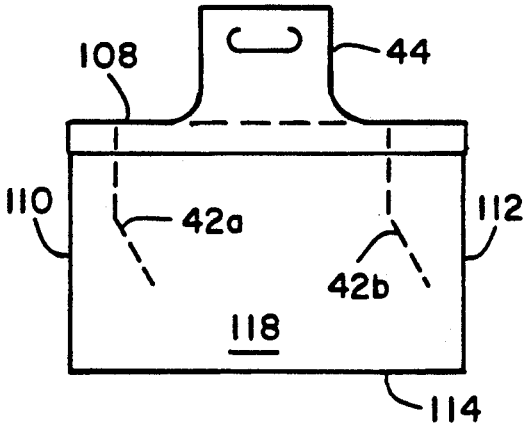
FIG. 7 representatively shows a side view of a filled bag having alternative, angled lines of frangibility.
Figure 8:
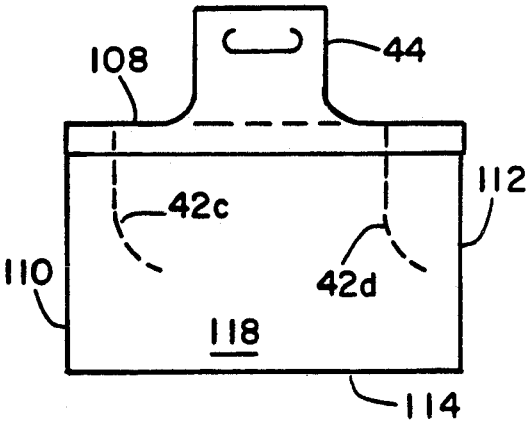
FIG. 8 representatively shows a side view of a bag having alternative, curvilinear lines of frangibility.

The shown embodiment of frangible line 42 extends across top gusset 52 along a direction which is substantially perpendicular to stack direction 100. Optionally, the frangible line can be arranged to extend across the top gusset along a direction which operably traverses across stack direction 100 at another selected, relative angle. With respect to front panel 22 and/or back panel 32, frangible line 42 extends across the front and/or back panels along a direction which is substantially perpendicular to stack direction 100. Alternatively, frangible line 42 may be configured to extend across front panel 22 and/or back panel 32 along a nonperpendicular, slant direction relative to stack direction 100, as representatively shown at 42*a* and 42*b* in FIG. 7. A significant portion of this section of the frangible line may slant toward or away from edge bond 37, as desired. In a particular aspect of the invention, the slant direction is angled not less than about 10 degrees from the stack direction. Preferably, the slant angle is not less than about 20 degrees, and more preferably is not less than about 30 degrees, as measured from stack direction 100. In yet another aspect of the invention, frangible line 42 may be curvilinear, as representatively shown at 42*c* and 42*d* in FIG. 8. The general curvature of the frangible line may be configured to bend toward (e.g. 42*d*) or bend away (e.g. 42*c*) from edge bond 37, as desired.

A particular aspect of the invention-comprises a frangible line 42 which extends across front panel 22 and/or back panel 32 over a distance which covers at least about 10 percent of depth dimension 72 of the front and/or back panels. Preferably, the extent of frangible line 42 is at least about 15 percent and more preferably is at least about 20 percent of depth dimension 72. In a further aspect of the invention, the frangible line extends across front panel 22 and/or back panel 32 over a distance which covers not more than about 60 percent of depth dimension 72 of the front and/or back panels. Preferably, the extent of frangible line 42 is not more than about 50 percent and more preferably is not more than about 40 percent of depth dimension 72.

The frangibility of line 42 may, for example, be provided by partially cutting or otherwise thinning through the thickness of the bag material in a predetermined pattern, providing a selected pattern of perforations along the appointed sections of the bag, providing a desired pattern of stress-fatigue weakening along the appointed sections of the bag, or the like. In the illustrated embodiment, frangible line 42 is provided by a line of perforations which extends across the appointed sections of top gusset 52 and front panel 22 and/or back panel 32. In particular embodiments, there can be approximately 2–10 perforations per lineal inch of frangible line 42. The shown embodiment, for example, includes a frangible line composed of alternating slits and lands. The slits are approximately ⅛ inch long and substantially aligned along the intended direction of frangibility. The lands also have a length dimension of ⅛ inch, as measured along the intended direction of frangibility.

Figure 6:
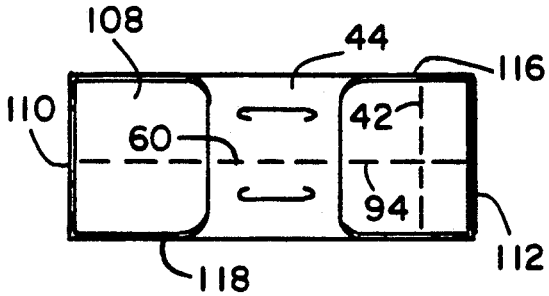
FIG. 6 representatively shows a top view of a filled bag.

Top gusset 52 may optionally include a supplemental line of frangibility 94 to facilitate access to the bag contents, as illustrated in FIG. 6. The supplemental frangibility of top gusset 52 may, for example, be provided by partially cutting or otherwise thinning through the thickness of the top gusset material in a predetermined pattern, providing a selected pattern of perforations along the top gusset, providing a desired pattern of stress-fatigue weakening along a section of the top gusset material, or the like. In the illustrated embodiment, supplemental frangible line 94 is provided by a line of perforations which extends generally along gusset fold line 68. Alternatively, supplemental frangible line 94 may be provided by a curvilinear or patterned arrangement of perforations distributed along a selected section of the top gusset. In the illustrated embodiment, there are approximately 3–4 perforations per lineal inch of the supplemental line of frangibility.

Handle web 44 (or handle web 45) is suitably connected to front panel 22 and back panel 32 to provide a bag carrying system. The handle web is composed of a flexible web material, such as a polymer material composed of a MDPE/LDPE film laminate or a HDPE film, which has sufficient tensile strength and sufficient load capacity to support the weight of a filled bag while the bag is suspended by the handle web. In the illustrated embodiment, for example, handle web 44 is composed of a MDPE/LDPE film material having a web thickness of about 4 mils (0.10 mm).

The handle web has a mounting portion 46 for connecting the handle web to the front and back panels. In the illustrated embodiment, mounting sections 46 of handle web 44 are constructed to extend substantially along the entire length of the top edge regions 28 and 38 of front panel 22 and back panel 32, respectively. As a result, the mounting sections can be attached, for example, with bonds 62, along substantially the entire top edge periphery of the filled package. Such a configuration can more widely spread and distribute the carrying stresses induced by using the handle web to transport a filled bag. Optionally, the mounting sections of handle web 44 may be bonded along an extent which is less than the entire length of the top edge regions of the front and back panels. Preferably, however, mounting sections 46 extend the entire length of the top edge regions of the front and back panels.

Handle web 38 can further include a strap portion 48 for providing a carrying loop 50. The carrying loop is constructed to continuously bridge over top gusset 52 and to extend between front panel 22 and back panel 32 in a generally arched configuration. As a result, carrying loop 50 can be arranged to provide for an arm suspension of bag 20 through the operation of loop 44.

In its arched configuration, carrying loop 50 provides two generally opposed loop faces 54 and 56. Each of the loop faces may optionally include at least one hand-grip opening 58 formed therein by a suitable technique, such as die-cutting. The hand-grip openings are configured for a hand-suspension of bag 20, and operably identify the hand-grip region of the carrying loop.

As representatively shown in FIG. 6, carrying loop 50 may include an appointed separation region, such as frangible section 60, which is located and arranged at an intermediate position between the hand-grip openings. The loop frangible section is constructed to provide for a separation and reconfiguration of the carrying loop into generally independently movable strap portions. The resultant strap portions are then capable of being individually repositioned to completely disconnect the original bridging between the front and back panels produced by carrying loop 50. Preferably, the carrying loop is substantially devoid of any seams or bonding lines which might excessively interfere with the desired separation of the appointed separation region.

In the illustrated embodiment, loop frangible section 60 defines a direction of separability (e.g., frangibility) which extends generally parallel with top edge region 28 of front panel 22. The separability of section 60 may be provided by any suitable treatment which reduces the strength of section 60 relative to the remainder of carrying loop 50. For example, the frangibility of section 60 may be provided by selectively reducing the web thickness along section 60, by providing a line of perforations along the frangible section, by inducing a pattern of stress-fatigue weakness along the frangible section, or by a like construction. While loop frangible section 60 may be relatively weaker than the remainder of carrying loop 50, the frangible section is constructed with sufficient tensile load capacity to permit the arm-suspension of bag 20 while the bag is substantially filled with contained articles. Strap portion 48 has a strap length and a strap width, and the loop frangible section 60 extends generally along the strap width. The strap length is selected to provide a loop size which is convenient for carrying while the bag is suspended from a user's arm through use of carrying loop 50. It will be readily apparent that the specific strap length will depend upon the final width dimension of a filled bag.

Figure 4:
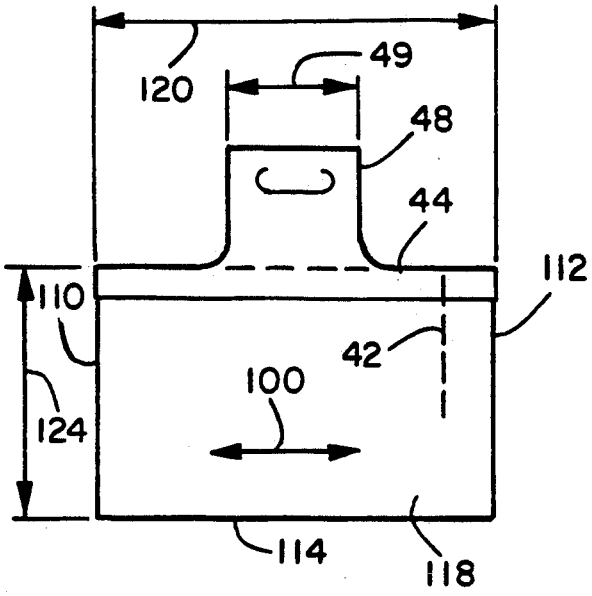
FIG. 4 representatively shows a side view of a filled bag having a frangible line extending generally perpendicular to the length of the bag.
Figure 5:
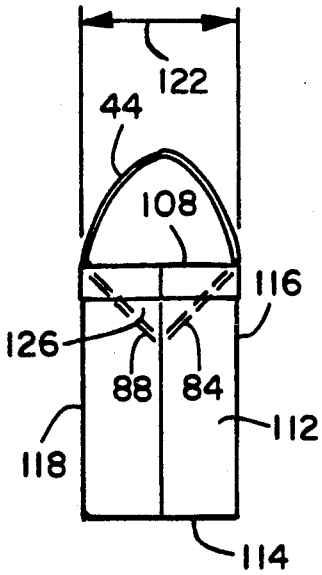
FIG. 5 representatively shows an end view of a filled bag.

Handle web 44 is configured to substantially avoid interference with the operation of frangible line 42. As previously mentioned, where mounting portion 46 of the handle web overlaps or otherwise intersects frangible line 42, the mounting portion includes a complementary mechanism of frangibility which cooperates with frangible line 42 to provide for the desired separation of the bag components along the location of the frangible line. In the shown embodiment, the width dimension 49 of strap portion 48 (FIG. 4) is less than the length 120 of the filled package, and the entirety of the strap portion is longitudinally spaced along stack direction 100 away from frangible line 42. More particularly, the entirety of carrying loop 50 is longitudinally spaced along stack direction 100 away from frangible line 42. As a result, when frangible line 42 is activated to open the filled package, no portion of strap 48 remains bridged over the frangible line. If a section of strap 48, such as carrying loop 50, remains bridged over the frangible line, the remaining bridged-over strap section can undesirably inhibit the desired movement of the separated bag components away from the location of the activated frangible line 42 and can excessively inhibit access to the articles within the package.

Figure 14:
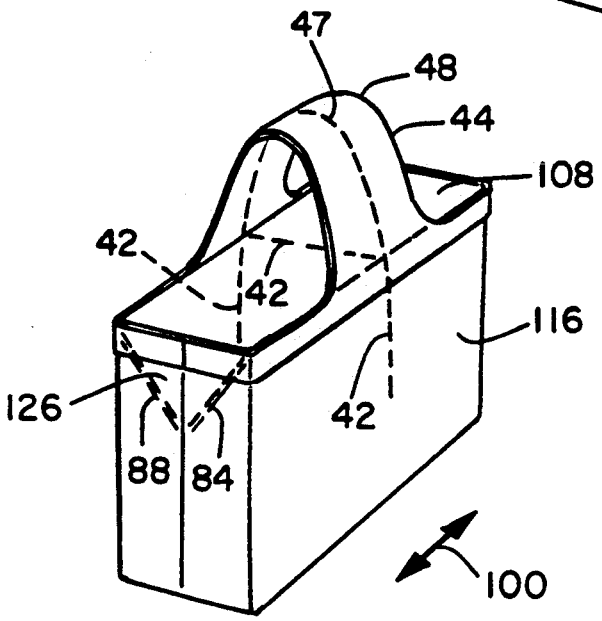
FIG. 14 representatively shows a perspective view of a filled bag of the invention in which a section of the handle strap of the bag is positioned coincident with the frangible line employed to open the bag.

In an aspect of the invention representatively shown in FIG. 14, a section of handle strap 48 is positioned coincident with frangible line 42. The handle strap is located along the package length such that a portion of the handle strap corresponds to and intersects the position of frangible line 42 along the package length. To provide a desired opening operation, strap 48 includes a complementary region of frangibility 47 which provides for at least a partial splitting separation of strap 48. In the particular shown embodiment, complementary frangible region 47 extends along the total length of strap 48 to provide for a complete splitting of the strap. As a result, when frangible line 42 has been activated, complementary frangible region 47 can also be activated to allow the package to more effectively open and provide improved access to the packaged articles. To carry the package after it has been opened, the split sections of strap 48 can be redrawn together for simultaneous grasping. The simultaneous grasping can advantageously help to hold the package closed and help prevent spilling of the contents.

Bag 20 is typically filled through its bottom, and the bottom edge regions of the front and rear panels are folded and suitably bonded to close the bottom of the bag against the bottom portions of the articles in a conventional manner well known to the packaging art. When substantially filled with the articles, the resulting package has a generally hexahedron shape, as representatively shown in FIG. 11.

Individual articles, such as individually folded diapers 96, generally define opposing side edges 98, a top edge 102, a bottom edge 104, and opposing face surfaces 106. The individual articles are stacked upon their respective face surfaces 106, and when the stacks are packaged, surfaces 106 face along stack direction 100 of bag 20. Accordingly, the top edges 102 of the articles contact the top wall of the package, the bottom edges 104 of the articles contact the bottom wall of the package, and the side edges 98 of the articles contact the package side walls. The end most articles of stack array 90 contact the end walls of the package.

Although the shown embodiment of stack array 90 is composed of a single stack of articles, it is readily apparent that the stack array may comprise a plurality of individual stacks. The individual stacks may be arranged side by side, top to bottom, or combinations thereof as desired. Each stack has a length 91 and a depth 13.

During use of the present invention, stack array 90 is compressed along stack direction 100 to reduce the length dimension of the completed package. Since articles 96 are resilient, the stack array tends to re-expand along stack direction 100 after the compressed stack of articles has been inserted into bag 20. This tendency to expand is restrained by the package walls, particularly end walls 110 and 112, front wall 116 and back wall 118. As a result, the expansion force exerted by the compressed articles applies a tensile stress to the end walls, front wall and back wall, and the applied stress generates a certain amount of resilient elastic strain or stretch within at least the front and back walls. Accordingly, the bag material is suitably selected and sized to withstand and accommodate the stresses and strains produced by the expansive forces generated by the compressed stack array 90 contained within the filled package. Preferably, the bag material is selected and sized such that it does not undergo excessive amounts of permanent, plastic deformation when stressed by the stacked array.

With reference to FIG. 11, bag 20 in its filled package form has a package length 120, a package width 122, and a package depth 124. Medial portions of front panel 22 and back panel 32 form package side walls 116 and 118, respectively. Longitudinal end regions of front panel 22 and back panel 32 form package end walls 110 and 112 with the bonding line of attachment 37 running along the end walls along the depth dimension of the filled package.

Top gusset member 52 becomes extended with the medial portion of the top gusset forming package top wall 108. As bag 20 is filled with articles, longitudinal end regions of top gusset 52 become folded and tucked into the interior of the package to form generally triangular-shaped tucks 126. Where diagonal bonds 84, 85, 88 and 89 are employed to secure selected portions of top gusset 52 to front panel 22 and back panel 32, tucks 126 are securely held against package end walls 110 and 112. As a result, the contained articles are substantially prevented from migrating into the space between tuck 126 and package end walls 110 and 112. Such migration could undesirably distort the package shape, inhibit efficient stacking of the filled packages, and degrade the aesthetic appearance of the packages when displayed on retail shelves.

Thus, bag 20 can advantageously provide an improved package which is composed of flexible material and contains a substantially stacked array 90 of compressed articles. The filled bag package comprises a front wall panel which has a top edge region and has an appointed lengthwise stack direction 100. Stacked array 90 extends substantially along the stack direction, and articles 96 are temporarily compressed along the stack direction when contained within the bag. A back wall panel 118 has a top edge region and is arranged in facing relation with front wall panel 116. A flexible top wall panel connects to the top edge regions of front wall panel 116 and back wall panel 118. A pair of spaced apart, opposed end wall panels 110 and 112 connect to the top wall panel and interconnect between the front and back wall panels. A bottom wall panel 114 connects to end wall panels 110 and 112, and also connects to the front and back wall panels to operably form the bottom of the package. Top wall panel 108 and one or more of the front and back wall panels have an appointed line of frangibility 42 extending at least partially there across along a direction which is transverse to stack direction 100. Frangible line 42 is entirely spaced away from each of the end panels. Accordingly, the complete and entire extent of frangible line 42 is spatially distant from both end wall 110 and end wall 112. The frangible line does not extend into either of the end walls, and may be constructed and arranged in accordance with the various configurations previously discussed with respect to the unfilled bag.

In the representatively shown embodiment, frangible line 42 extends completely across top wall 108 and extends partially across both back wall 118 and front wall 116. A particular aspect of the invention comprises a frangible line 42 which extends across front wall 116 and/or back wall 118 over a distance which covers at least about 10 percent of depth dimension 124 of the front and/or back walls. Preferably, the extent of frangible line 42 is at least about 15 percent and more preferably is at least about 20 percent of depth dimension 124. In a further aspect of the invention, the frangible line extends across front wall 116 and/or back wall 118 over a distance which covers not more than about 70 percent of depth dimension 124 of the front and/or back walls. Preferably, the extent of frangible line 42 is not more than about 60 percent and more preferably is not more than about 50 percent of depth dimension 124.

To open the package, frangible line 42 is broken or otherwise separated to gain access to the articles contained within the package. Typically, the separation of frangible line 42 is initiated along the portion of the frangible line which is located within top wall 108. The separation is then propagated along frangible line 42 and into the sections of the frangible line that are located in front wall 116 and/or back wall 118. In the illustrated embodiment, frangible line 42 extends into both the front and back walls of the package. As a result, the separating of frangible line 42 releases the tension within the resultant separated regions of front wall 116 and back wall 118. The remaining, unseparated regions of the front and back walls remain intact and continue to hold a bottom portion of the stacked array of articles in compression. The separated sections of front wall 116 and back wall 118, however, are released from tension. As a result, the resilient elasticity exhibited by the sections of previously tensioned and strained material causes the separated portions to resiliently contract and move away from the original location of frangible line 42. The flexibility and relatively easy deformability of the unseparated sections of bag material are suitably selected to operably cooperate with the retraction of the separated portions of front wall 116 and back wall 118. This allows the top section of the package to sufficiently expand open and expose individual articles 96 for removal through separation opening. Thus, the top section of the package can split and bend open along the separation region 128 derived from frangible line 42.

The opening of separation region 128 also operably releases the compression within the correspondingly positioned top portions of stacked articles 96, and allows the top portions of adjacent articles to move away from each other. As a result, the user can more readily reach between individual articles to grasp a selected article for removal. In addition, the partial removal of compression within stack array 90 can advantageously reduce the frictional forces between adjacent articles 96 and allow the articles to more easily slide past one another. Thus, the compression release aspect of the invention can further assist in the removal of the initial articles taken from a newly opened package.

Optional supplemental line of frangibility 94 may also be employed to further open top wall 108 and gain additional access through the top wall of the package. Such additional access may, for example, be desired when a partially filled bag is employed as temporary "luggage" to carry accessory articles, such as lotions, powders or cleansing wipes. Supplemental frangible line 94 may be substantially straight, such as illustrated in FIG. 6, or may be curvilinear, such as a line with a serpentine or zig-zag configuration.

Where employed, frangible section 60 in strap portion 48 of handle web 44 ( or handle web 45) can be cut, broken, or otherwise separated into two movable strap portions. The movable strap portions may be conveniently draped to the sides of the bag to provide a convenient, substantially unimpeded access to package top wall 108. Supplemental frangible line 94 can then be more easily reached to gain access through the top wall of the package. After the package has been opened, the separated strap portions can still be employed to carry the package. In particular, the movable strap portions can be redrawn together in an adjacent facing relation so that a person's hand can be simultaneously inserted through both of the grip openings 58. Once the carrying operation is completed, the strap portions can again be repositioned and draped away from top wall 108 to facilitate access to the articles through the top of the open package.

The aspect of the invention wherein the bag includes a handle web 45 which bridges over top wall 108 and extends along the length dimension 120 of the package can provide further advantages. In particular, the use of such a handle configuration can generate a pair of carrying forces which are applied upwardly and directed along the two end walls 112 of the package. The applied forces create a squeezing action which operates to contract the top dimension of the package. The squeezing action tends to close separation region 128, and can help reduce the probability of spillage.

Having thus described the invention in rather full detail, it will be readily apparent that various changes and modifications may be made without departing from the spirit of the invention. All of such changes and modifications are contemplated as being within the scope of the invention, as defined by the subjoined claims.

I claim:

1. A bag for receiving and containing a substantially stacked array of selected articles, said bag comprising:

a flexible front panel which has two opposed side edge regions and a top edge region, and which has an appointed lengthwise stack direction;

a flexible back panel having two opposed side edge regions and a top edge region, said back panel connected in facing relation to said front panel along the side edge regions thereof;

a flexible top gusset connected to the top edge regions of said front panel and back panel, said top gusset constructed to provide a top wall panel having an effective width dimension between said front and back panels when said top gusset is in its extended wall condition; and a handle web which includes a strap portion which bridges over said top gusset and connects to said front and back panels along said top edge regions thereof;

said top gusset and at least one of said front and back panels having an appointed first line of frangibility extending at least partially there-across along a direction which is transverse to said stack direction, said line of frangibility entirely spaced from each of said panel side edge regions by a distance which is not less than one-half of said effective width dimension of said top gusset, said first line of frangibility positioned to coincide with said bridging strap portion of said handle web, and said strap portion having a complementary line of frangibility which extends transversely over said top gusset in coinciding alignment with said first line of frangibility, said complementary line of frangibility providing for a complete separation of sections of said strap portion which restrict a parting movement of bag sections away from separations formed along said first line of frangibility.

2. A bag as recited in claim 1, wherein said first line of frangibility extends across said top panel and at least partially across each of said front and back panels.

3. A bag as recited in claim 1, wherein said first line of frangibility extends across said top panel along a direction which is substantially perpendicular to said stack direction.

4. A bag as recited in claim 1, wherein said first line of frangibility extends across said front or back panels along a direction which is substantially perpendicular to said stack direction.

5. A bag as recited in claim 1, wherein said first line of frangibility extends across said front or back panel over a distance which covers at least about 10% of a depth dimension of said front or back panel.

6. A bag as recited in claim 1, wherein said first line of frangibility extends across said front or back panel over a distance which covers not more than about 60% of a depth dimension of said front or back panel.

7. A bag as recited in claim 1 wherein said line of frangibility extends across said front and back panels over a distance which covers at least about 10 percent of a depth dimension of said front and back panels.

8. A bag as recited in claim 1, wherein said line of frangibility extends across said front and back panels over a distance which covers not more than about 60 percent of a depth dimension of said front and back panels.

9. A bag composed of flexible material and containing a substantially stacked array of compressed articles, said bag comprising:

a front wall which has a top edge region and has an appointed lengthwise stack direction, said stacked array extending substantially along said stack direction and said articles compressed along said stack direction when contained within said bag;

a back wall which has a top edge region and is arranged in facing relation to said front wall;

a flexible top wall connected to the top edge regions of said front wall and said back wall;

a pair of spaced apart, opposed end walls which connect to said top wall and interconnect between said front and back walls;

a bottom wall which connects to said end walls and said front and back walls; and a handle web having a strap portion which connects to said front and back walls along said top edge regions thereof and bridges over said top wall;

said top wall and at least one of said front and back walls having an appointed first line of frangibility extending at least partially there-across along a direction which is transverse to said stack direction, said lie of frangibility being entirely spaced from each of said end walls and positioned to coincide with a section of said bridging strap portion of said handle web, said strap portion having a complementary line of frangibility which extends over said top gusset transversely to said stack direction and coincides with said first line of frangibility, said complementary line of frangibility providing for a complete separation of sections of said strap portion which restrict a parting movement of bag sections away from separations formed along said first line of frangibility.

10. A bag as recited in claim 9, wherein said first line of frangibility extends across said top wall and at least partially across each of said front and back walls.

11. A bag as recited in claim 9, wherein said first line of frangibility extends across said top wall along a direction which is substantially perpendicular to said stack direction.

12. A bag as recited in claim 9, wherein said first line of frangibility extends across said front and/or back walls along a direction which is substantially perpendicular to said stack direction.

13. A bag as recited in claim 9, wherein said first line of frangibility extends across said front or back wall over a distance which covers at least about 15% of a depth dimension of said front or back wall.

14. A bag as recited in claim 9, wherein said first line of frangibility extends across said front or back wall over a distance which covers not more than about 70% of a depth dimension of said front or back wall.

15. A bag as recited in claim 9, wherein said compressed articles, when contained within said bag, induce a resiliently elastic strain along said stack direction within at least said front and back walls.

16. A bag as recited in claim 9, wherein said line of frangibility extends across said front and back walls over a distance which covers at least about 15 percent of a depth dimension of said front and back walls.

17. A bag as recited in claim 9, wherein said line of frangibility extends across said front and back walls over a distance which covers not more than about 70 percent of a depth dimension of said front and back walls.

18. A bag for receiving and containing a substantially stacked array of selected articles, said bag comprising:

a flexible front panel which has two opposed side edge regions and a top edge region, and which has an appointed lengthwise stack direction;

a flexible back panel having two opposed side edge regions and a top edge region, said back panel connected in facing relation to said front panel along the side edge regions thereof; and a flexible top gusset connected to the top edge regions of said front panel and back panel, said top gusset constructed to provide a top wall panel having an effective width dimension between said front and back panels when said top gusset is in its extended wall condition; and a handle web which includes a strap portion which bridges transverse to said stack direction over said top gusset between said front and back panels and connects to said front and back panels along said top edge regions thereof;

said top gusset and at least one of said front and back panels having an appointed first line of frangibility extending at least partially there-across along a direction which is transverse to said stack direction, said line of frangibility entirely spaced from each of said panel side edge regions by a distance which is not less than one-half of said width dimension of said top wall panel, said first line of frangibility positioned to coincide with a section of said strap portion of said handle web, and said strap portion having a complementary line of frangibility which extends transversely over said top gusset and intersects said first line of frangibility, said complementary line of frangibility providing for a complete separation of sections of said strap portion which restrict a parting movement of bag sections away from separations formed along said first line of frangibility.

19. A bag for receiving and containing a substantially stacked array of selected articles, said bag comprising:

a flexible front panel which has two opposed side edge regions and a top edge region, and which has an appointed lengthwise stack direction;

a flexible back panel having two opposed side edge regions and a top edge region, said back panel connected in facing relation to said front panel along the side edge regions thereof; and a flexible top gusset connected to the top edge regions of said front panel and back panel, said top gusset constructed to provide a top wall panel having an effective width dimension between said front and back panels when said top gusset is in its extended wall condition;

a handle web which connects to said front and back panels along said top edge regions thereof and includes a strap portion for bridging along said stack direction of said bag and over said top gusset;

said top gusset and at least one of said front and back panels having an appointed first line of frangibility extending at least partially there-across along a direction which is transverse to said stack direction, said line of frangibility entirely spaced from each of said panel side edge regions by a distance which is not less than one-half of said width dimension of said top wall panel, said strap portion of the handle web having a complementary line of frangibility which extends transverse to said stacking direction over said top gusset and coincides with said first line of frangibility, said complementary line of frangibility providing for a complete separation of sections of said strap portion which restrict a parting movement of bag sections away from separations formed along said first line of frangibility.

20. A bag composed of flexible material and containing a substantially stacked array of compressed articles, said bag comprising:

a front wall which has a top edge region and has an appointed lengthwise stack direction, said stacked array extending substantially along said stack direction and said articles compressed along said stack direction when contained within said bag;

a back wall which has a top edge region and is arranged in facing relation to said front wall;

a flexible top wall connected to the top edge regions of said front wall and said back wall;

a pair of spaced apart, opposed end walls which connect to said top wall and interconnect between said front and back walls;

a bottom wall which connects to said end walls and said front and back walls; and a handle web having a strap portion which connects to said end walls along top edge regions thereof and bridges longitudinally along said stack direction over said top wall;

said top wall and at least one of said front and back walls having an appointed first line of frangibility extending at least partially thereacross along a direction which is transverse to said stack direction, said line of frangibility being entirely spaced from each of said end walls, and said strap portion having a complementary line of frangibility which extends over said top gusset transversely to said stack direction in coinciding alignment with said first line of frangibility, said complementary line of frangibility providing for a complete separation of sections of said strap portion which restrict a parting movement of bag sections away from separations formed along said first line of frangibility.

21. A bag composed of flexible material and containing a substantially stacked array of compressed articles, said bag comprising:

a front wall which has a top edge region and has an appointed lengthwise stack direction, said stacked array extending substantially along said stack direction and said articles compressed along said stack direction when contained within said bag;

a back wall which has a top edge region and is arranged in facing relation to said front wall;

a flexible top wall connected to the top edge regions of said front wall and said back wall;

a pair of spaced apart, opposed end walls which connect to said top wall and interconnect between said front and back walls;

a bottom wall which connects to said end walls and said front and back walls; and a handle web having a strap portion which connects to said front and back walls along said top edge regions thereof and bridges transversely to said stack direction over said top wall between said front and back walls;

said top wall and at least one of said front and back walls having an appointed first line of frangibility extending at least partially thereacross along a direction which is transverse to said stack direction, said line of frangibility being entirely spaced from each of said end walls and positioned coincident with a section of said strap portion of said handle web, said strap portion having a complementary line of frangibility which extends over said top gusset transversely to said stack direction, intersects said first line of frangibility, said complementary line of frangibility providing for a complete separation of sections of said strap portion which restrict a parting movement of bag sections away from separations formed along said first line of frangibility.

* * * * *